US009793618B2

(12) United States Patent
Sone et al.

(10) Patent No.: US 9,793,618 B2
(45) Date of Patent: Oct. 17, 2017

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kosuke Sone, Mie (JP); Hiroyoshi Maesoba, Mie (JP); Tomohide Maki, Mie (JP); Katsushi Miyazaki, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/113,919

(22) PCT Filed: Jan. 23, 2015

(86) PCT No.: PCT/JP2015/051773
§ 371 (c)(1),
(2) Date: Jul. 25, 2016

(87) PCT Pub. No.: WO2015/122256
PCT Pub. Date: Aug. 20, 2015

(65) Prior Publication Data

US 2016/0344110 A1 Nov. 24, 2016

(30) Foreign Application Priority Data

Feb. 12, 2014 (JP) ..... 2014-024101

(51) Int. Cl.
*H01R 4/18* (2006.01)
*H01R 24/38* (2011.01)
(Continued)

(52) U.S. Cl.
CPC ..... *H01R 4/184* (2013.01); *H01R 13/506* (2013.01); *H01R 13/741* (2013.01); *H01R 24/38* (2013.01); *H01R 24/58* (2013.01); *H01R 2107/00* (2013.01)

(58) Field of Classification Search
CPC .... H01R 4/184; H01R 13/506; H01R 13/741; H01R 24/38; H01R 24/58
(Continued)

(56) References Cited

U.S. PATENT DOCUMENTS 5,993,230 A 11/1999 Gauker et al.
6,837,732 B2 * 1/2005 Pavlovic ..... H01R 13/7197 333/182
(Continued)

FOREIGN PATENT DOCUMENTS

JP 3-101880 10/1991
JP 2002-75543 3/2002
(Continued)

OTHER PUBLICATIONS

International Search Report.

*Primary Examiner* — Alexander Gilman
(74) *Attorney, Agent, or Firm* — Gerald E. Hespos; Michael J. Porco; Matthew T. Hespos

(57) ABSTRACT

A connector (10) includes a housing (20) with terminal holding portions (20A to 20D) and terminal fittings (60) in the respective terminal holding portions (20A to 20D). Each terminal fitting (60) includes a terminal main body (62A to 62D) having an annular portion (61A to 61 D) arranged substantially along a front-back direction. A wire connecting
(Continued)

portion (63A to 63D) is connected to a rear end of the terminal main body (62A to 62D) and is connectable to a wire (W). The terminal holding portion (20A to 20D) includes a holding main body (21A to 21D) configured so that the annular portion (61A to 61D) is to be fit thereto, and a protecting portion (22A to 22D) intersecting with and integrally connected to a rear end of the holding main body (21A to 21D) and arranged to cover the wire connecting portion (63A to 63D) from the front and/or behind.

4 Claims, 9 Drawing Sheets

(51) Int. Cl.
*H01R 24/58* (2011.01)
*H01R 13/506* (2006.01)
*H01R 13/74* (2006.01)
*H01R 107/00* (2006.01)

(58) Field of Classification Search
USPC ..... 439/675, 352, 466
See application file for complete search history.

(56) References Cited

U.S. PATENT DOCUMENTS

| | | | | |
|---|---|---|---|---|
| 6,964,579 | B2 * | 11/2005 | Seminara | F42B 3/26 439/188 |
| 7,004,778 | B2 * | 2/2006 | Barker | H01R 13/631 439/352 |
| 7,121,892 | B2 * | 10/2006 | Johannes | H01R 13/7197 439/620.07 |
| 7,566,223 | B2 | 7/2009 | Wadsworth | |
| 9,409,536 | B2 * | 8/2016 | Gunreben | B60R 21/16 |
| 2002/0009918 | A1 * | 1/2002 | Banas | H01R 24/58 439/404 |
| 2002/0115335 | A1 * | 8/2002 | Saito | H01R 12/727 439/466 |

FOREIGN PATENT DOCUMENTS

| | | |
|---|---|---|
| JP | 2002-75558 | 3/2002 |
| JP | 2002-513501 | 5/2002 |
| JP | 2002-246107 | 8/2002 |

* cited by examiner

CONNECTOR

BACKGROUND

1. Field of the Invention

The present invention relates to a connector.

2. Description of the Related Art

A connector disclosed in Japanese Unexamined Patent Publication No. 2002-246107 includes a connector housing having a plurality of terminal accommodating portions and terminal fittings to be inserted into the terminal accommodating portions. The terminal fitting is L-shaped as a whole and includes a terminal main body having a tongue piece capable of resiliently contacting a mating male tab and arranged substantially along a front-back direction, and a wire fixing portion arranged to stand upward from the rear end of the terminal main body and to be crimped and connected to an end part of a wire.

Further, the connector includes a retainer to be mounted into the connector housing to cover the wire fixing portions from behind with the terminal main bodies inserted in the terminal accommodating portions. The terminal fittings are retained and held in the terminal accommodating portions by the retainer. According to Japanese Unexamined Patent Publication No. 2002-246107, since the wires connected to the terminal fittings are pulled out in a direction intersecting with the front-back direction, a space behind the connector can be effectively utilized.

Further, a connector disclosed in Japanese Unexamined Patent Publication No. 2002-75543 includes a louver terminal having a pair of annular front and rear ring portions and a plurality of resilient strip portions extending in a front-back direction and linking the both ring portions, a housing main body having a terminal accommodating portion into which the louver terminal is to be fitted, and an auxiliary housing having a fitting portion fittable into the terminal accommodating portion from behind and to be press-fitted and held into the housing main body. When the connector is connected to a mating connector, a terminal accommodating tube of the mating connector is inserted into the terminal accommodating tube from front, a shield shell covering the outer surface of the terminal accommodating portion is inserted into the louver terminal and each resilient strip portion of the louver terminal is resiliently pressed against the shield shell to be electrically connected.

By applying the technique of the louver terminal disclosed in Japanese Unexamined Patent Publication No. 2002-75543 to the terminal fitting disclosed in Japanese Unexamined Patent Publication No. 2002-246107, a terminal fitting can be configured which includes a terminal main body having annular ring portions and a wire fixing portion bent and integrally connected to the rear end of the terminal main body. However, since a structure for preventing a backward detachment of the terminal fitting (equivalent to the retainer in Japanese Unexamined Patent Publication No. 2002-246107 and the auxiliary housing in Japanese Unexamined Patent Publication No. 2002-75543) is provided separately from a structure for holding the terminal fitting (equivalent to the connector housing in Japanese Unexamined Patent Publication No. 2002-246107 and the terminal accommodating portion in Japanese Unexamined Patent Publication No. 2002-75543) in both Japanese Unexamined Patent Publication No. 2002-246107 and Japanese Unexamined Patent Publication No. 2002-75543, there is a problem that the number of components increases and component management and the like are cumbersome.

The present invention was completed based on the above situation and aims to reduce the number of components in a connector with a terminal fitting having an annular portion and to be connected to a wire.

SUMMARY

The present invention is directed to a connector with a terminal fitting, and a terminal holding portion configured to hold the terminal fitting, wherein the terminal fitting includes a terminal main body having an annular portion and arranged substantially along a front-back direction and a wire connecting portion bent and integrally connected to a rear end of the terminal main body and to be connected to a wire, and the terminal holding portion includes a holding main body configured such that the annular portion is to be fitted thereto and arranged substantially along the front-back direction, and a protecting portion intersecting with and integrally connected to a rear end of the holding main body and arranged to cover the wire connecting portion from front or/and behind.

Since the wire connecting portion is bent and integrally connected to the rear end of the terminal main body, the wire extending from the wire connecting portion can be arranged in a direction intersecting with the front-back direction and a space behind the connector can be effectively utilized. Further, since the holding main body, to which the annular portion is to be fitted, and the protecting portion arranged to cover the wire connecting portion from front or/and behind are integrally provided, the number of components can be smaller as compared to the case where the holding main body and the protecting portion are separately provided. Note that the above annular portion is not limited to an endlessly annular portion continuous over the entire circumference and may be an annular portion with open circumferential ends.

The connector further includes a housing formed by combining a plurality of the terminal holding portions. Each of the terminal holding portions may include an inner terminal holding portion having the holding main body arranged inside the housing and having the annular portion fit externally to the holding main body. An outer terminal holding portion has the holding main body arranged outside the housing and has the annular portion fit internally to the holding main body. Thus, the terminal fitting is held in the holding main body of the inner terminal holding portion and is arranged inside the housing. Additionally, the terminal fitting is held in the holding main body of the outer terminal holding portion and is arranged outside the housing to be overlapped and arranged in the front-back direction. Accordingly, the connector is not enlarged in the front-back direction.

The housing may be formed with a plurality of terminal accommodating chambers capable of individually accommodating the wire connecting portions by combining the protecting portions of the plurality of terminal holding portions and partition plates integrally projecting on the respective protecting portions. This eliminates the need for a special structure for forming the terminal accommodating chambers in addition to the protecting portions and the partition plates. Thus, the number of components is reduced further.

Plural terminal fittings of different shapes may be held in the terminal holding portion. Additionally, the respective annular portions of the terminal fittings may be arranged side by side in the front-back direction in the holding main body, and the respective wire connecting portions of the terminal fittings may be arranged side by side in a width direction in the protecting portion. Accordingly, the differently shaped terminal fittings are held efficiently in the terminal holding portion and space saving is excellent.

DETAILED DESCRIPTION

Figure 8:
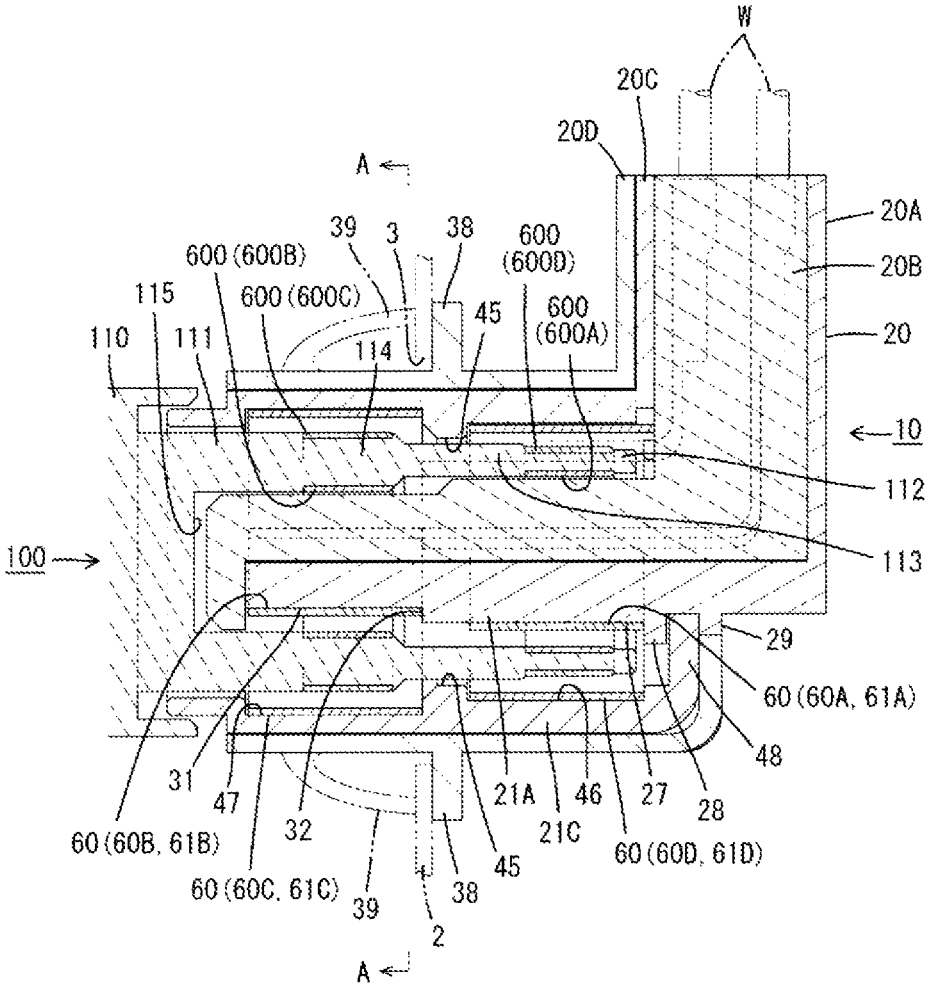
FIG. 8 is a side view in section showing a state where the connector is connected to a mating connector.

A connector 10 of an embodiment is described on the basis of the drawings. As shown in FIG. 8, the connector 10 is connectable to a mating connector 100 and includes a housing 20 made of synthetic resin and a plurality of terminal fittings 60 made of metal. Note that, in the following description, connection surface sides of the two connectors 10, 100 (surface sides facing each other when connection is started) are referred to as front sides concerning a front-back direction and a vertical direction is based on each drawing.

First, the structure of the mating connector 100 is described. As shown in FIG. 8, the mating connector 100 includes a mating housing 110 made of synthetic resin and a plurality of mating terminal fittings 600 made of metal. The mating housing 110 includes a cylindrical receptacle 111 projecting forward.

As shown in FIG. 8, the receptacle 111 includes a leading portion 112 located on a front end part, an intermediate portion 113 formed to be thicker than the leading portion 112 and connected to the rear end of the leading portion 112 via a tapered step part, and a rear portion 114 formed to be thicker than the intermediate portion 113 and connected to the rear end of the intermediate portion 113 via a tapered step part. The rear end of the rear portion 114 is closed by a back wall 115.

A circular ring part of a first mating terminal fitting 600A is fitted or inserted into the leading portion 112 to be mounted on the inner peripheral surface of the leading portion 112. A circular ring part of a fourth mating terminal fitting 600D is fitted or inserted onto the leading portion 112 to be mounted on the outer peripheral surface of the leading portion 112.

Further, a circular ring part of a second mating terminal fitting 600B is fitted or inserted into the rear portion 114 to be mounted on the inner peripheral surface of the rear portion 114. A circular ring part of a third mating terminal fitting 600C is fitted or inserted onto the rear portion 114 to be mounted on the outer peripheral surface of the rear portion 114.

Figure 9:
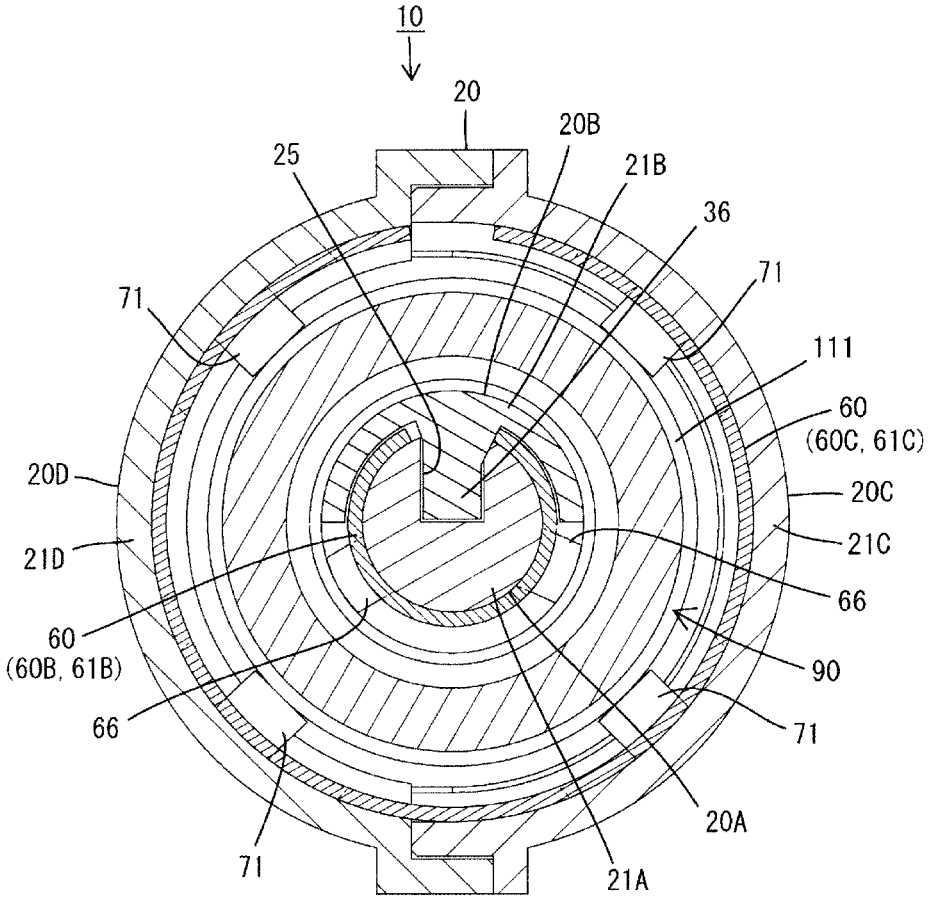
FIG. 9 is a section along A-A of FIG. 8.

Next, the structure of the housing 20 is described. As shown in FIGS. 8 and 9, the housing 20 is configured by combining a plurality of terminal holding portions 20A, 20B, 20C and 20D. The terminal fittings 60 are held in the terminal holding portions 20A, 20B, 20C and 20D. The plurality of terminal holding portions 20A, 20B, 20C and 20D are composed of first and second inner terminal holding portions 20A, 20B located inside the housing 20 and third and fourth outer terminal holding portions 20C, 20D located outside the housing 20. Note that, in the following description, structures common to the plurality of terminal holding portions 20A, 20B, 20C and 20D have the same names and are denoted by the same reference signs unless it is particularly necessary to distinguish them.

Figure 2:
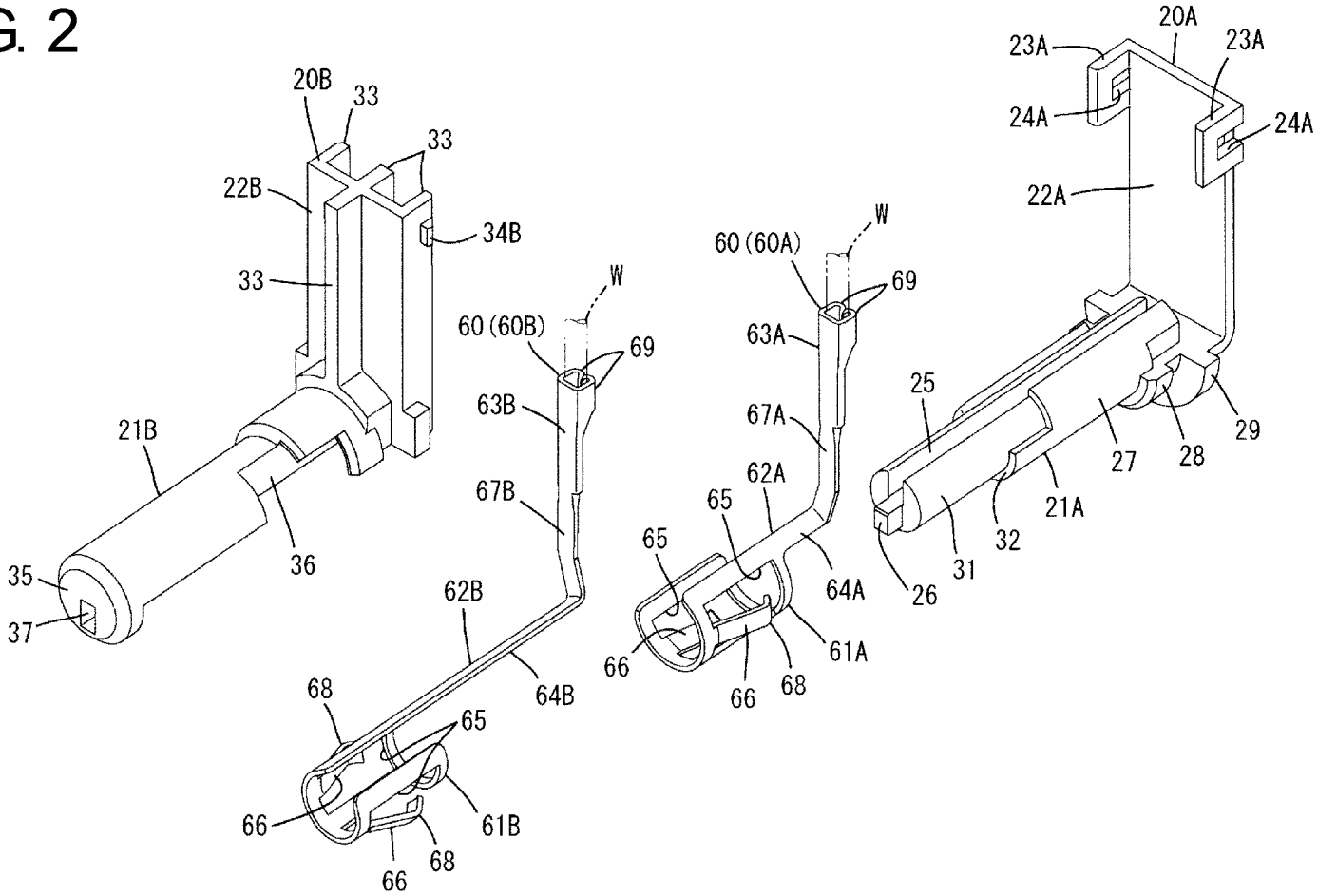
FIG. 2 is an exploded perspective view of the connector.

As shown in FIG. 2, the first inner terminal holding portion 20A includes a first holding main body 21A in the form of a bar arranged substantially along the front-back direction and a first protecting portion 22A in the form of a flat plate intersecting with and integrally connected to the rear end of the first holding main body 21A and arranged to stand upward. The first protecting portion 22A is in the form of a rectangular plate standing upright with plate surfaces facing in the front-back direction. A pair of first lock pieces 23A projecting forward are provided on the upper ends of both left and right side edges of the first protecting portion 22A. The first lock pieces 23A are resiliently deformable in a width direction (lateral direction) and include first lock holes 24A penetrating in the width direction.

The first holding main body 21A is provided with a fitting groove 25 extending in the front-back direction and open on the upper end. A projection 26 in the form of a rectangular block projects right below an opening on the front end of the fitting groove 25 on the front surface of the first holding main body 21A.

As shown in FIG. 8, a first mounting surface 27 in the form of an arcuate surface to which a first annular portion 61A (described later) of the first terminal fitting 60A is to be externally fitted is provided on a rear part of the outer peripheral surface of the first holding main body 21A. By externally fitting the first annular portion 61A to the first mounting surface 27, the first terminal fitting 60A is held in the first inner terminal holding portion 20A. As shown in FIG. 2, an arcuate ridge 28 extending in a circumferential direction is provided right behind the first mounting surface 27 on the rear part of the outer peripheral surface of the first holding main body 21A. Further, an arcuate rear ridge 29 extending in the circumferential direction is provided behind and at a distance from the ridge 28 on the outer peripheral surface of the first inner terminal holding portion 20A.

As shown in FIG. 8, a second mounting surface 31 in the form of an arcuate surface to which a second annular portion 61B (described later) of the second terminal fitting 60B is to be fit externally is provided on a front part of the outer peripheral surface of the first holding main body 21A. By externally fitting the second annular portion 61B to the second mounting surface 31, the second terminal fitting 60B is held in the first inner terminal holding portion 20A. The second mounting surface 31 has a smaller diameter than the first mounting surface 27. As shown in FIG. 2, a step portion 32 slightly lowered toward the second mounting surface 31 is provided between the first and second mounting surfaces 27, 31 on the front part of the outer peripheral surface of the first holding main body 21A.

As shown in FIG. 2, the second inner terminal holding portion 20B includes a second holding main body 21B having an arcuate cross-section and arranged substantially along the front-back direction and a second protecting portion 22B in the form of a flat plate intersecting with and integrally connected to the rear end of the second holding main body 21B and arranged to stand upward. The second protecting portion 22B is in the form of a rectangular plate standing upright with plate surfaces facing in the front-back direction. Partition plates 33 extending in the vertical direction (height direction) integrally project on both left and right side edges and a widthwise central part of the rear surface of the second protecting portion 22B. Further, a partition plate 33 extending in the vertical direction also integrally projects on a widthwise central part of the front surface of the second protecting portion 22B. Two claw-like second lock projections 34B are provided on outer upper end parts of a pair of partition plates 33 located on the left and right side edges of the second holding main body 21B out of the respective partition plates 33.

As shown in FIG. 2, the front end of the second holding main body 21B is closed by a disk-shaped closing wall 35. An arcuate surface area to which the first and second annular portions 61A, 61B are respectively internally fitted is provided on the inner peripheral surface of the second holding main body 21B. A fitting rib 36 in the form of a hanging plate extending in the front-back direction is provided on the upper end of the inner peripheral surface of the second holding main body 21B. A rectangular projection receiving hole 37 is provided on the closing wall 35 to be open right below the front end of the fitting rib 36.

Figure 6:
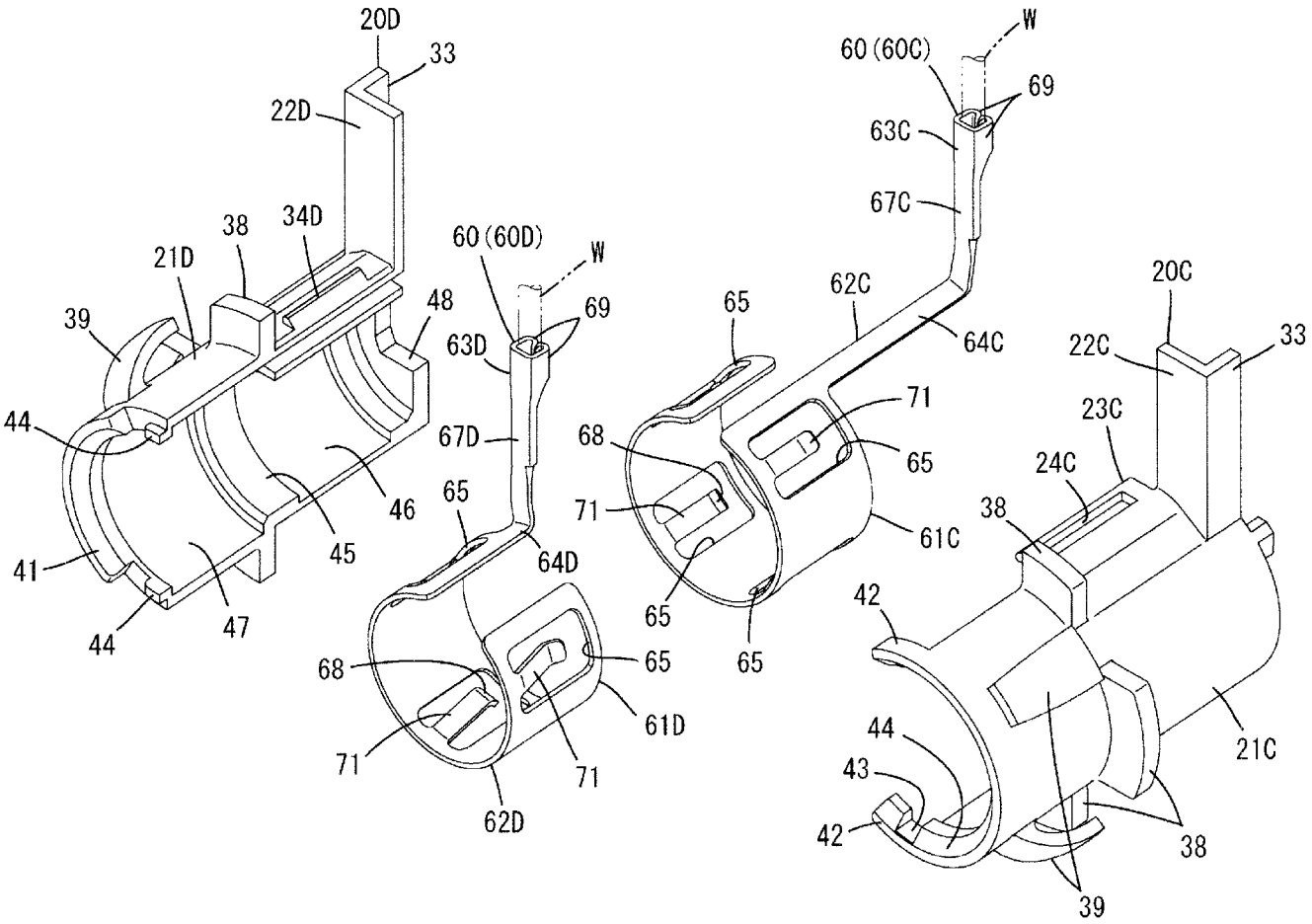
FIG. 6 is an exploded perspective view of third and fourth outer terminal holding portions and third and fourth terminal fittings.
Figure 7:
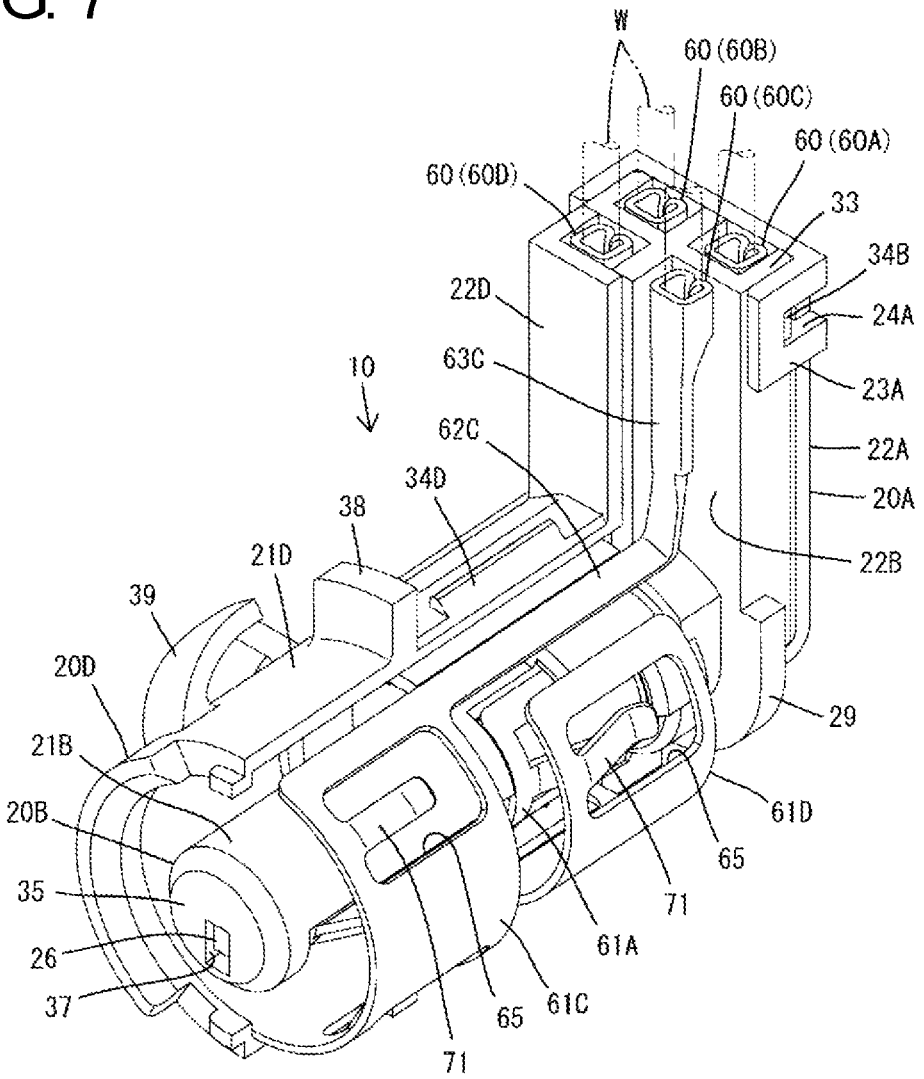
FIG. 7 is a perspective view of the connector excluding the fourth outer terminal holding portion.

As shown in FIG. 6, the third outer terminal holding portion 20C includes a third holding main body 21C having an arcuate cross-section (specifically a semicircular cross-section) and arranged substantially along the front-back direction and a third protecting portion 22C in the form of a flat plate intersecting with and integrally connected to the upper edge of the rear end of the third holding main body 21C and arranged to stand upward. The third protecting portion 22C is a rectangular plate standing upright with plate surfaces facing in the front-back direction. A partition plate 33 intersecting substantially at a right angle integrally projects backward on an outer end (end part distant from the fourth outer terminal holding portion 20D at the time of assembling) of the third protecting portion 22C. The partition plate 33 is coupled to the outer end of the third protecting portion 22C over the entire length in the vertical direction and the partition plate 33 and the third protecting portion 22C form an L-shaped cross-section.

As shown in FIG. 6, a plurality of flange portions 38 in the form of arcuate plates stand in an intermediate part of the outer peripheral surface of the third holding main body 21C in the front-back direction while being spaced apart in the circumferential direction. Further, a pair of strip-like resilient pieces 39 are provided before spaces between adjacent flange portions 38 on the outer peripheral surface of the third holding main body 21C. The resilient piece 39 is cantilevered to project toward an outer rear side in a curved manner and resiliently deformable in a radial direction.

A thick arcuate rib 41 extending in the circumferential direction is provided on the front end of the third holding main body 21C. Both upper and lower end parts of the arcuate rib 41 are connected to a pair of projecting pieces 42 projecting inwardly with respect to the circumferential direction (side where the fourth outer terminal holding portion 20D is located). The projecting pieces 42 are provided with a pair of third locking portions 43 in the form of cuts. Further, a third lock piece 23C projecting short inwardly with respect to the circumferential direction is provided between the flange portion 38 and the third protecting portion 22C on the upper edge of a rear part of the third holding main body 21C. The third lock piece 23C is resiliently deformable in a radial direction and includes a third lock hole 24C penetrating in the radial direction. The third lock piece 23C and the third lock hole 24C extend long and narrow in the front-back direction.

As shown in FIG. 8, a strip-like portion 45 extending in the circumferential direction projects in an intermediate part of the inner peripheral surface of the third holding main body 21C in the front-back direction. On the inner peripheral surface of the third holding main body 21C, a fourth mounting surface 46 in the form of an arcuate surface to which a fourth annular portion 61D (described later) of the fourth terminal fitting 60D is to be internally fitted is provided behind the strip portion 45, and a third mounting surface 47 in the form of an arcuate surface to which a third annular portion 61C (described later) of the third terminal fitting 60C is to be internally fitted is provided before the strip portion 45. Further, a plate-like stopping portion 48 is provided to protrude radially inwardly on the rear end of the third holding main body 21C.

As shown in FIG. 6, the fourth outer terminal holding portion 20D includes a fourth holding main body 21D having an arcuate cross-section (specifically a semicircular cross-section) and arranged substantially along the front-back direction and a fourth protecting portion 22D in the form of a flat plate intersecting with and integrally connected to the upper edge of the rear end of the fourth holding main body 21D and arranged to stand upward. The fourth protecting portion 22D is a rectangular plate standing upright with plate surfaces facing in the front-back direction. A partition plate 33 intersecting substantially at a right angle integrally projects backward on an outer end (end part distant from the third outer terminal holding portion 20C at the time of assembling) of the fourth protecting portion 22D. The partition plate 33 is coupled to the outer end of the fourth protecting portion 22D over the entire length in the vertical direction and the partition plate 33 and the fourth protecting portion 22D form an L-shaped cross-section.

A plurality of flange portions 38 in the form of arcuate plates stand in an intermediate part of the outer peripheral surface of the fourth holding main body 21D in the front-back direction while being spaced apart in the circumferential direction. Further, a pair of strip-like resilient pieces 39 are provided before spaces between adjacent flange portions 38 on the outer peripheral surface of the fourth holding main body 21D. The resilient piece 39 is cantilevered to project toward an outer rear side in a curved manner and resiliently deformable in a radial direction.

A thick arcuate rib 41 extending in the circumferential direction is provided on the front end of the fourth holding main body 21D. A pair of fourth locking portions 44 in the form of cuts are provided on both upper and lower end parts of the arcuate rib 41. Further, a claw-like fourth lock projection 34D is provided between the flange portion 38 and the fourth protecting portion 22D on the upper edge of the rear end of the fourth holding main body 21D. The fourth lock projection 34D extends long and narrow in the front-back direction along the upper edge of the fourth holding main body 21D.

A strip-like portion 45 extending in the circumferential direction projects in an intermediate part of the inner peripheral surface of the fourth holding main body 21D in the front-back direction. On the inner peripheral surface of the fourth holding main body 21D, a fourth mounting surface 46 in the form of an arcuate surface to which the fourth annular portion 61D of the fourth terminal fitting 60D is to be internally fitted is provided behind the strip portion 45, and a third mounting surface 47 in the form of an arcuate surface to which the third annular portion 61C of the fourth terminal fitting 60C is to be internally fitted is provided before the strip portion 45. Further, a plate-like stopping portion 48 is provided to protrude radially inwardly on the rear end of the fourth holding main body 21D.

Next, the structure of the terminal fitting 60 is described. The terminal fitting 60 is formed by applying bending and the like to an electrically conductive metal plate punched out into a predetermined shape. There are the first to fourth terminal fittings 60A, 60B, 60C and 60D independent of each other. Note that, in the following description, structures common to the first to fourth terminal fittings 60A, 60B, 60C and 60D have the same names and are denoted by the same reference signs unless it is particularly necessary to distinguish them.

As shown in FIG. 2, the first terminal fitting 60A is L-shaped as a whole and includes a first terminal main body 62A arranged substantially along the front-back direction and a first wire connecting portion 63A bent and integrally connected to the rear end of the first terminal main body 62A and arranged to stand upward. The first terminal main body 62A is composed of a first front-back coupling portion 64A in the form of a thin strip extending substantially straight in the front-back direction and the first annular portion 61A extending in an arcuately curved manner in the circumferential direction from a front part of the first front-back coupling portion 64A.

As shown in FIG. 2, the first annular portion 61A is in the form of a curved strip having a predetermined width in the front-back direction. The first annular portion 61A is provided with a pair of U-shaped openings 65 spaced apart in the circumferential direction, and an inner contact piece 66 is provided in each opening 65. The inner contact piece 66 is in the form of a cantilever extending backward from a front end part of the first annular portion 61A and facing the opening 65. Specifically, the inner contact piece 66 is in the form of a thin strip bent inwardly after obliquely extending to an outer rear side and includes a contact portion 68 on an outer side of a bent part.

The first wire connecting portion 63A is composed of a first bent coupling portion 67A connected substantially at a right angle to the rear end of the first front-back coupling portion 64A and standing up and a pair of crimping pieces 69 in the form of a barrel projecting from both left and right side edges of an upper part of the first bent coupling portion 67A. The both crimping pieces 69 are crimped and wound around an end part of a wire W and electrically and mechanically connected to the wire W.

The second terminal fitting 60B is L-shaped as a whole and includes a second terminal main body 62B arranged substantially along the front-back direction and a second wire connecting portion 63B bent and integrally connected to the rear end of the second terminal main body 62B and arranged to stand upward. The second terminal main body 62B is composed of a second front-back coupling portion 64B in the form of a thin strip extending substantially straight in the front-back direction and the second annular portion 61B with an end extending in an arcuately curved manner in the circumferential direction from a front part of the second front-back coupling portion 64B. A length of the second front-back coupling portion 64B in the front-back direction is longer than that of the first front-back coupling portion 64A.

The second annular portion 61B is in the form of a curved strip having a predetermined width in the front-back direction and has a diameter smaller than the first annular portion 61A. A curving direction (counterclockwise in a front view) of the second annular portion 61B is opposite to that (clockwise in a front view) of the first annular portion 61A. The second annular portion 61B is provided with a pair of U-shaped openings 65 spaced apart in the circumferential direction, and an inner contact piece 66 is provided in each opening 65. The inner contact piece 66 is shaped similarly to the inner contact piece 66 of the first annular portion 61A.

The second wire connecting portion 63B is composed of a second bent coupling portion 67B connected substantially at a right angle to the rear end of the second front-back coupling portion 64B and standing up and a pair of crimping pieces 69 in the form of a barrel projecting from both left and right side edges of an upper part of the second bent coupling portion 67B. A vertical length of the second bent coupling portion 67B is substantially equal to that of the first bent coupling portion 67A. The second wire connecting portion 63B is shaped entirely similarly to the first wire connecting portion 63A.

As shown in FIG. 6, the third terminal fitting 60C is L-shaped as a whole and includes a third terminal main body 62C arranged substantially along the front-back direction and a third wire connecting portion 63C bent and integrally connected to the rear end of the third terminal main body 62C and arranged to stand upward. The third terminal main body 62C is composed of a third front-back coupling portion 64C in the form of a thin strip extending substantially straight in the front-back direction and the third annular portion 61C with an end extending in an arcuately curved manner in the circumferential direction from a front part of the third front-back coupling portion 64C.

The third annular portion 61C is in the form of a curved strip having a predetermined width in the front-back direction and has a diameter larger than the first annular portion 61A. The third annular portion 61C is provided with four U-shaped openings 65 spaced apart in the circumferential direction, and an outer contact piece 71 is provided in each opening 65. The outer contact piece 71 is in the form of a cantilever extending backward from a front end part of the third annular portion 61C and facing the opening 65. Specifically, the outer contact piece 71 is in the form of a thin strip bent outwardly after obliquely extending to an inner rear side and includes a contact portion 68 on an inner side of a bent part.

The third wire connecting portion 63C is composed of a third bent coupling portion 67C connected substantially at a right angle to the rear end of the third front-back coupling portion 64C and standing up and a pair of crimping pieces 69 in the form of a barrel projecting from both left and right side edges of an upper part of the third bent coupling portion 67C. The third wire connecting portion 63C is shaped similarly to the first wire connecting portion 63A except in that a vertical length of the third front-back coupling portion 64C is shorter than that of the first front-back coupling portion 64A.

As shown in FIG. 6, the fourth terminal fitting 60D is L-shaped as a whole and includes a fourth terminal main body 62D arranged substantially along the front-back direction and a fourth wire connecting portion 63D bent and integrally connected to the rear end of the fourth terminal main body 62D and arranged to stand upward. The fourth terminal main body 62D is composed of a fourth front-back coupling portion 64D in the form of a thin strip extending substantially straight in the front-back direction and the fourth annular portion 61D with an end extending in an arcuately curved manner in the circumferential direction from the fourth front-back coupling portion 64D. A length of the fourth front-back coupling portion 64D in the front-back direction is shorter than that of the third front-back coupling portion 64C.

The fourth annular portion 61D is in the form of a curved strip having a predetermined width in the front-back direction and has a diameter smaller than the third annular portion 61C. A curving direction (counterclockwise in a front view) of the fourth annular portion 61D is opposite to that (clockwise in a front view) of the third annular portion 61C. The fourth annular portion 61D is provided with three U-shaped openings 65 spaced apart in the circumferential direction, and an outer contact piece 71 is provided in each opening 65. The outer contact piece 71 of the fourth annular portion 61D is shaped similarly to the outer contact piece 71 of the third annular portion 61C.

The fourth wire connecting portion 63D is composed of a fourth bent coupling portion 67D connected substantially at a right angle to the rear end of the fourth front-back coupling portion 64D and standing up and a pair of crimping pieces 69 in the form of a barrel projecting from both left and right side edges of an upper part of the fourth bent coupling portion 67D. A vertical length of the fourth bent coupling portion 67D is substantially equal to that of the third bent coupling portion 67C. The fourth wire connecting portion 63D is shaped entirely similarly to the third wire connecting portion 63C.

Next, how to assemble the connector 10 and how to connect the connector 10 and the mating connector 100 are described.

Figure 3:
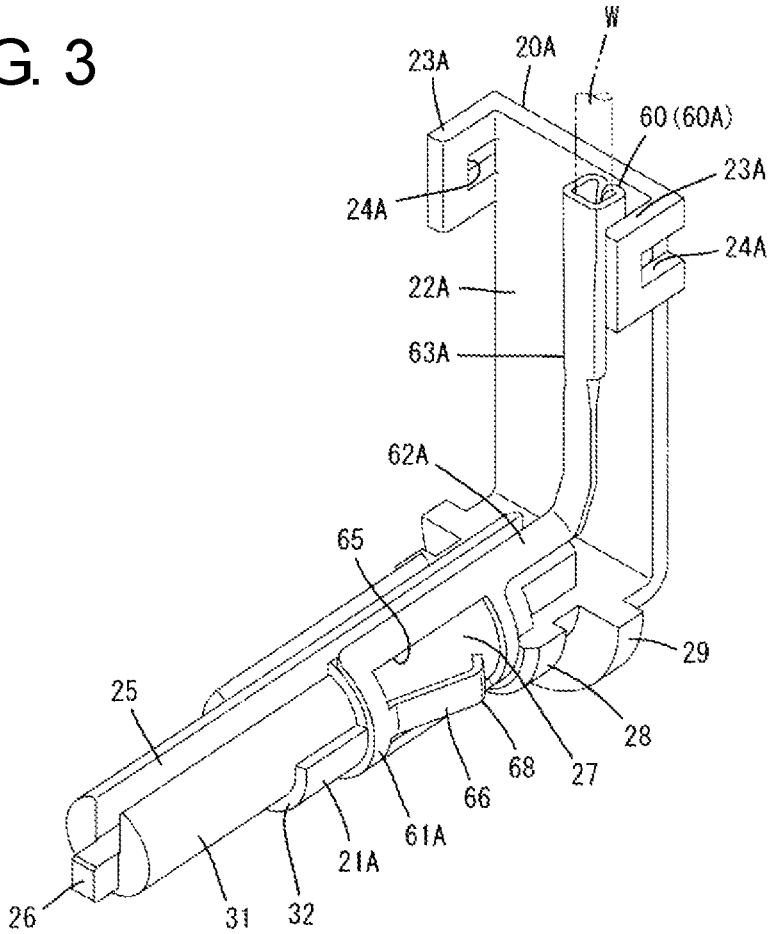
FIG. 3 is a perspective view showing a state where a first terminal fitting is held in a first inner terminal holding portion.

First, the crimping pieces 69 of each of the first to fourth wire connecting portions 63A, 63B, 63C and 63D are crimped and connected to the wire W. Subsequently, as shown in FIG. 3, the first annular portion 61A is fitted to the first mounting surface 27 of the first holding main body 21A from front and the first terminal fitting 60A is held in the first inner terminal holding portion 20A. When the first terminal fitting 60A is held in the first inner terminal holding portion 20A, the first front-back coupling portion 64A is arranged in the front-back direction along the outer peripheral surface of the first holding main body 21A and the first bent coupling portion 67A is vertically arranged along the front surface of the first protecting portion 22A. Further, the rear end of the first annular portion 61A is stopped in contact with the ridge 28.

Figure 4:
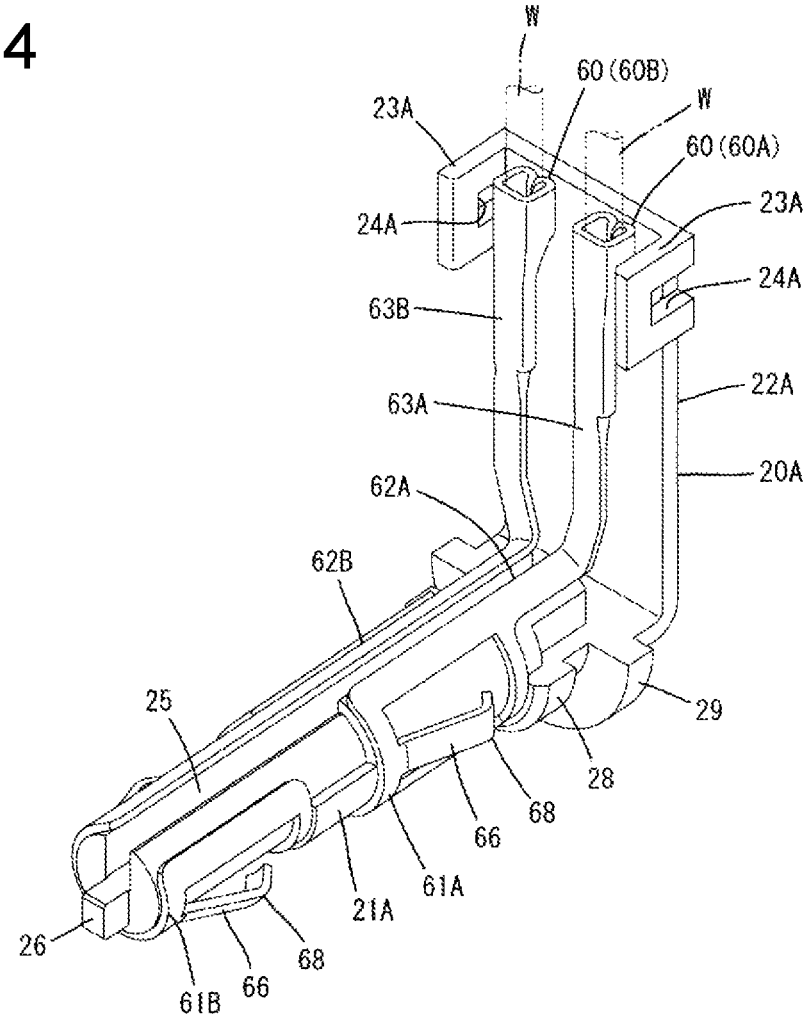
FIG. 4 is a perspective view showing a state where a second terminal fitting is further held in the first inner terminal holding portion.

Subsequently, as shown in FIG. 4, the second annular portion 61B is fitted to the second mounting surface 31 of the first holding main body 21A from front and the second terminal fitting 60B is held in the first inner terminal holding portion 20A. When the second terminal fitting 60B is held in the first inner terminal holding portion 20A, the second front-back coupling portion 64B is juxtaposed with the first front-back coupling portion 64A in the width direction and arranged along the outer peripheral surface of the first holding main body 21A and the second bent coupling portion 67B is juxtaposed with the first bent coupling portion 67A in the width direction and arranged along the front surface of the first protecting portion 22A. Further, the rear end of the second annular portion 61B is stopped in contact with the step portion 32.

Figure 5:
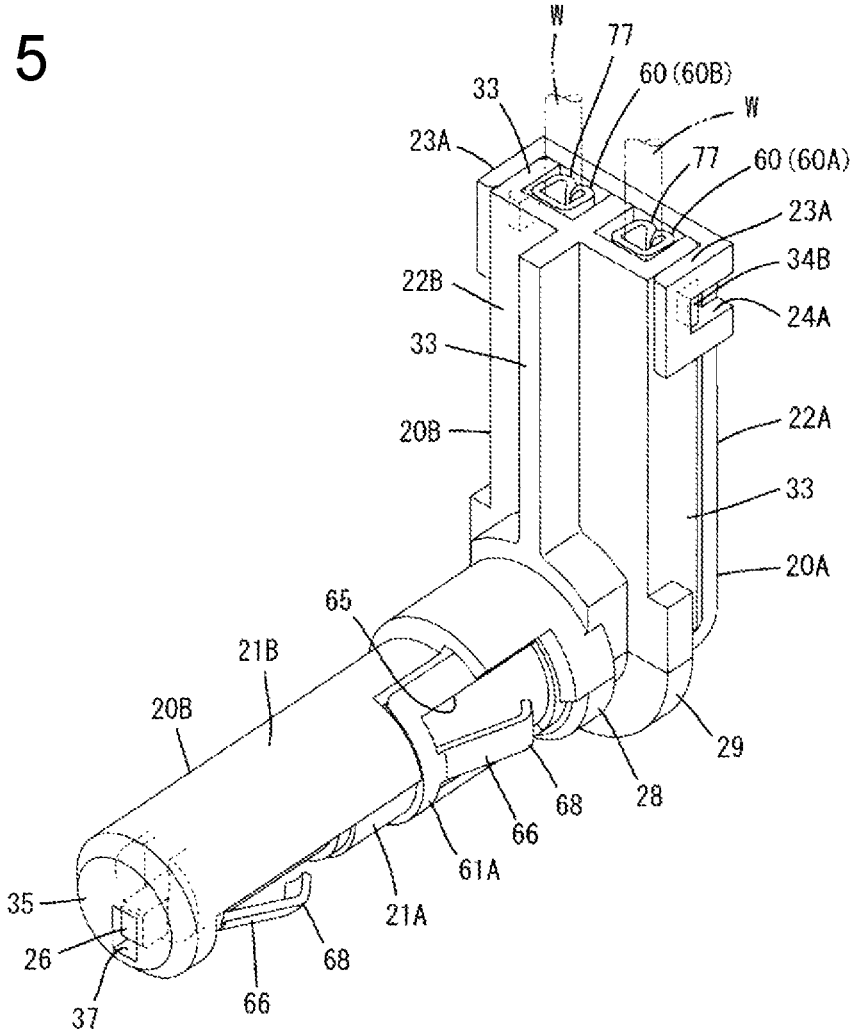
FIG. 5 is a perspective view showing a state where a second inner terminal holding portion is assembled with the first inner terminal holding portion.

Subsequently, as shown in FIG. 5, the second inner terminal holding portion 20B is assembled to cover the first inner terminal holding portion 20A from front. The partition plates 33 of the second protecting portion 22B are arranged to be able to come into contact with the front surface of the protecting portion 22A and the both second lock projections 34B are resiliently fitted into the first lock holes 24A of the both first lock pieces 23A, whereby the second inner terminal holding portion 20B is assembled and held on the first inner terminal holding portion 20A. Further, the fitting rib 36 is fitted and inserted into the fitting groove 26 of the first holding main body 21A and the projection 26 is inserted into the projection receiving hole 37, whereby the second inner terminal holding portion 20B is positioned and held on the first inner terminal holding portion 20A. Furthermore, a pair of terminal accommodating chambers 77 having a rectangular cross-section and extending in the vertical direction are formed between the first and second protecting portions 22A, 22B and the respective partition plates 33, and the first and second wire connecting portions 63A, 63B are respectively accommodated into the both terminal accommodating chambers 77. The first and second wire connecting portions 63A, 63B are covered and protected from behind by the first protecting portion 22A and covered and protected from front by the second protecting portion 22B, and arranged side by side in the width direction between the first and second protecting portions 22A, 22B.

When the second inner terminal holding portion 20B is assembled with the first inner terminal holding portion 20A, the first and second front-back coupling portions 64A, 64B and the first and second annular portions 61A, 61B are partly covered by the second holding main body 21B, whereas the respective inner contact pieces 66 of the first and second terminal fittings 60A, 60B are arranged to be exposed.

Further, the third annular portion 61C is laterally fitted to the third mounting surface 47 of the third holding main body 21C to hold the third terminal fitting 60C in the third outer terminal holding portion 20C. When the third terminal fitting 60C is held in the third outer terminal holding portion 20C, the third front-back coupling portion 64C is arranged in the front-back direction along the inner peripheral surface of the third holding main body 21C and the third bent coupling portion 67C is vertically arranged along the rear surface of the third protecting portion 22C. Further, the rear end of the third annular portion 61C is stopped in contact with the strip-like portion 45.

Before or after the above operation, the fourth annular portion 61D is laterally fitted to the fourth mounting surface 47 of the fourth holding main body 21D to hold the fourth terminal fitting 60D in the fourth outer terminal holding portion 20D. When the fourth terminal fitting 60D is held in the fourth outer terminal holding portion 20D, the fourth front-back coupling portion 64D is arranged in the front-back direction along the inner peripheral surface of the fourth holding main body 21D and the fourth bent coupling portion 67D is vertically arranged along the rear surface of the fourth protecting portion 22D.

Figure 1:
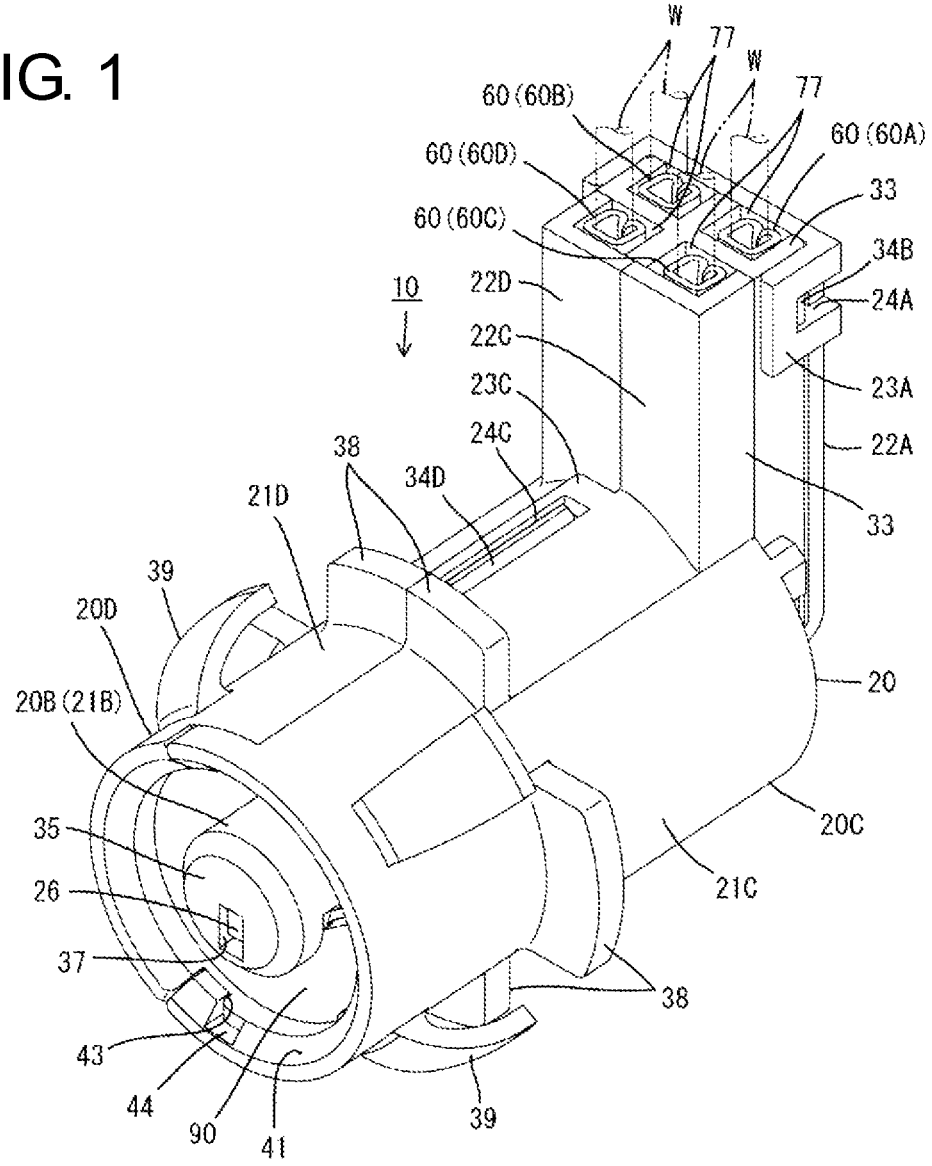
FIG. 1 is a perspective view of a connector according to an embodiment of the present invention.

Subsequently, the third and fourth outer terminal holding portions 20C, 20D are assembled with each other from opposite widthwise sides by butting the inner ends of the third and fourth holding main bodies 21C, 21D against each other with the first and second holding main bodies 21A, 21B arranged inside. Then, as shown in FIG. 1, the third and fourth locking portions 43, 44 are locked to be meshed with each other and the fourth lock projection 34D is resiliently fitted into the third lock hole 24C of the third lock piece 23C. In this way, the third and fourth outer terminal holding portions 20C, 20D are assembled and held while enclosing the first and second holding main bodies 21A, 21B. As the third and fourth outer terminal holding portions 20C, 20D are assembled, the stopping portions 48 of the third and fourth outer terminal holding portions 20C, 20D are fitted and inserted into between the ridge 28 and the rear ridge 29 of the first inner terminal holding portion 20A (see FIG. 8). In this way, the first and second inner terminal holding portions 20A, 20B are positioned in the front-back direction and held in the third and fourth outer terminal holding portions 20C, 20D.

As the above assembling is performed, the fourth annular portion 61D is internally fitted and mounted to the fourth mounting surface 46 of the third holding main body 21 and the third annular portion 61C is internally fitted and mounted to the third mounting surface 47 of the fourth holding main body 21D. Then, a connection space 90 (see FIG. 1) open forward is formed between the first and second holding main bodies 21A, 21B and the third and fourth holding main bodies 21C, 21D. The inner contact pieces 66 of the first and second terminal fittings 60A, 60B, and the outer contact pieces 71 of the third and fourth terminal fittings 60C, 60D are arranged to project into this connection space 90. Then, the first and fourth annular portions 61A, 61D are arranged at positions overlapping each other in the front-back direction and the second and third annular portions 61B, 61C are arranged at positions overlapping each other in the front-back direction. Specifically, the first annular portion 61A is arranged in a range contained in a range of the fourth annular portion 61D in the front-back direction and the second annular portion 61B is arranged in a range contained in a range of the third annular portion 61C in the front-back direction (see FIG. 8).

Further, as the above assembling is performed, a pair of terminal accommodating chambers 77 having a rectangular cross-section and extending in the vertical direction are formed between the second protecting portion 22B, the third protecting portion 22C and the fourth protecting portion 22D and the respective partition plates 33, and the third and fourth wire connecting portions 63C, 63D are respectively accommodated into the both terminal accommodating chambers 77. The third and fourth wire connecting portions 63C, 63D are covered and protected from behind by the second protecting portion 22B and covered and protected from front by the third and fourth protecting portions 22C, 22D. In this way, the first to fourth wire connecting portions 63A, 63B, 63C and 63D are accommodated in the respective terminal accommodating chambers 77 while being insulated from each other. Then, the respective wires W connected to the first to fourth wire connecting portions 63A, 63B, 63C and 63D are pulled out in an upward direction intersecting with the front-back direction from the upper ends of the respective terminal accommodating chambers 77.

The connector 10 produced in this way is inserted into a mounting hole 3 of a plate-like mounting portion 2 as shown in FIG. 8. When the connector 10 is properly inserted into the mounting hole 3, each resilient piece 39 exits from the mounting hole 3 and is resiliently locked to the front surface of the mounting portion 2 and each flange portion 38 is arranged to be able to come into contact with the rear surface of the mounting portion 2. This causes the connector 10 to be retained and mounted on the mounting portion 2. At this time, the connector 10 is inserted with a predetermined clearance into the mounting hole 3 and radially displaceable within the range of that clearance.

With the connector 10 mounted on the mounting portion 2, the receptacle 111 of the mating connector 100 is fitted and inserted into the connection space 90 of the connector 10. When the receptacle 111 is properly inserted into the connection space 90, the inner peripheral surfaces of the circular ring parts of the first and second mating terminal fittings 600A, 600B respectively resiliently contact the contact portions 68 of the inner contact pieces 66 of the first and second terminal fittings 60A, 60B, and the inner peripheral surfaces of the circular ring parts of the third and fourth mating terminal fittings 600C, 600D respectively resiliently contact the contact portions 68 of the outer contact pieces 71 of the third and fourth terminal fittings 60C, 60D. In this way, the first to fourth mating terminal fittings 600A, 600B, 600C and 600D are electrically connected to the first to fourth terminal fittings 60A, 60B, 60C and 60D.

In the above case, even if connection axes of the mating connector 100 and the connector 10 are radially deviated from each other, the connector 10 is radially displaced within the range of the clearance in the mounting hole 3, thereby properly correcting the deviation of the connection axes. Further, since the circular ring parts of the first to fourth mating terminal fittings 600A, 600B, 600C and 600D are connected to the respective contact portions 68 of the first to fourth terminal fittings 60A, 60B, 60C and 60D, it is not necessary to distinguish directionality about the connection axes when the two connectors 10, 100 are connected. Thus, according to this embodiment, a degree of freedom in connecting the two connectors 10, 100 is enhanced.

As described above, according to this embodiment, the first to fourth wire connecting portions 63A, 63B, 63C and 63D are respectively bent and integrally connected to the rear ends of the first to fourth terminal main bodies 62A, 62B, 62C and 62D and the wires W extending from the first to fourth wire connecting portions 63A, 63B, 63C and 63D are pulled out in the upward direction intersecting with the front-back direction. Thus, the space behind the connector 10 can be effectively utilized. Further, since the first to fourth protecting portions 22A, 22B, 22C and 22D are intersecting with and integrally connected to the rear ends of the first to fourth holding main bodies 21A, 21B, 21C and 21D, an increase in the number of components can be prevented.

Further, the housing 20 is formed by combining the first and second inner terminal holding portions 20A, 20B and the third and fourth outer terminal holding portions 20C, 20D, the first and second terminal fittings 60A, 60B are held in the first and second inner terminal holding portions 20A, 20B and the third and fourth terminal fittings 60C, 60D are held in the third and fourth outer terminal holding portions 20C, 20D, whereby the first and fourth annular portions 61A, 61D are arranged at the positions overlapping each other in the front-back direction and the second and third annular portions 61B, 61C are arranged at the positions overlapping each other in the front-back direction. Thus, the enlargement of the connector 10 in the front-back direction can be avoided.

Furthermore, since a plurality of terminal accommodating chambers 77 capable of individually accommodating the first to fourth wire connecting portions 63A, 63B, 63C and 63D are formed by combining the first to fourth protecting portions 22A, 22B, 22C and 22D and the respective partition plates 33 integrally projecting from these, a special structure for forming the terminal accommodating chambers 77 is not necessary in addition to the first to fourth protecting portions 22A, 22B, 22C and 22D and the respective partition plates 33. Thus, the overall configuration can be simplified and the number of components can be further reduced.

The present invention is not limited to the above described and illustrated embodiment. For example, the following modes are also included in the technical scope of the present invention.

Although the connector is provided with four terminal holding portions and four terminal fittings in the above embodiment, the numbers of the terminal holding portions and the terminal fittings are arbitrary. For example, a housing may be configured by a single terminal holding portion (e.g. first inner terminal holding portion of the above embodiment) and a member for covering a terminal fitting held in the terminal holding portion (e.g. dedicated cover member).

The first to fourth annular portions may have a circular ring shape continuous over the entire circumference.

The wire may be connected to the wire connecting portion by soldering or welding.

The wire pulled out from the wire connecting portion may be arranged in either one of leftward and rightward directions or in a downward direction without being limited to the upward direction.

The wire connecting portion may be connected to the rear end of the terminal main body to extend in an oblique direction intersecting with the front-back direction instead of being connected at a right angle.

The protecting portion may be connected to the rear end of the holding main body to extend in an oblique direction intersecting with the front-back direction instead of being connected at a right angle.

The protecting portion may be arranged to cover the wire connecting portion in only one direction either from front or from behind.

LIST OF REFERENCE SIGNS

10 . . . connector
20 . . . housing
20A . . . first inner terminal holding portion (terminal holding portion)
20B . . . second inner terminal holding portion (terminal holding portion)
20C . . . third outer terminal holding portion (terminal holding portion)
20D . . . fourth outer terminal holding portion (terminal holding portion)
21A . . . first holding main body (holding main body)
21B . . . second holding main body (holding main body)
21C . . . third holding main body (holding main body)
21D . . . fourth holding main body (holding main body)
22A . . . first protecting portion (protecting portion)
22B . . . second protecting portion (protecting portion)
22C . . . third protecting portion (protecting portion)
22D . . . fourth protecting portion (protecting portion)
33 . . . partition plate
60 . . . terminal fitting
61A . . . first annular portion (annular portion)
61B . . . second annular portion (annular portion)
61C . . . third annular portion (annular portion)
61D . . . fourth annular portion (annular portion)
62A . . . first terminal main body (terminal main body)
62B . . . second terminal main body (terminal main body)
62C . . . third terminal main body (terminal main body)
62D . . . fourth terminal main body (terminal main body)
63A . . . first wire connecting portion (wire connecting portion)
63B . . . second wire connecting portion (wire connecting portion)
63C . . . third wire connecting portion (wire connecting portion)
63D . . . fourth wire connecting portion (wire connecting portion)
77 . . . terminal accommodating chamber
W . . . wire

The invention claimed is:

1. A connector, comprising:

at least one terminal fitting including a terminal main body having an annular portion arranged substantially along a front-back direction and a wire connecting portion bent and integrally connected to a rear end of the terminal main body and to be connected to a wire; and a housing configured to hold the terminal fitting, the housing being formed by combining an inner terminal holding portion and an outer terminal holding portion, each of the terminal holding portions includes a holding main body configured such that the annular portion of the terminal fitting is to be fitted thereto and arranged substantially along the front-back direction, and a protecting portion intersecting with and integrally connected to a rear end of the holding main body and arranged to cover the wire connecting portion from front and/or behind, the holding main body of the inner terminal holding portion being arranged at an inner position in the housing and having the annular portion of the terminal fitting externally fitted thereon and the holding main body of the outer terminal holding portion being arranged outside the holding main body of the inner terminal holding portion and having the annular portion internally fitted therein.

2. The connector of claim 1, wherein the at least one terminal fitting comprises a plurality of the terminal fittings, and wherein the housing is formed with a plurality of terminal accommodating chambers capable of individually accommodating the wire connecting portions of the terminal fittings by combining the protecting portions of the plurality of terminal holding portions, and partition plates integrally projecting on the respective protecting portions between the terminal accommodating chambers.

3. The connector of claim 2, wherein:

the terminal fittings are different in shape from one another and are held in the terminal holding portion;

the respective annular portions of the plurality of terminal fittings are arranged side by side in the front-back direction in the holding main bodies of the terminal holding portions; and the respective wire connecting portions of the plurality of terminal fittings are arranged side by side in a width direction in the protecting portions of the terminal holding portions.

4. The connector of claim 1, wherein:

the terminal fittings are different in shape from one another and are held in the terminal holding portion;

the respective annular portions of the plurality of terminal fittings are arranged side by side in the front-back direction in the holding main bodies of the terminal holding portions; and the respective wire connecting portions of the plurality of terminal fittings are arranged side by side in a width direction in the protecting portions of the terminal holding portions.

* * * * *